US008075761B2

(12) United States Patent
Kohler et al.

(10) Patent No.: US 8,075,761 B2
(45) Date of Patent: Dec. 13, 2011

(54) HYDROCARBON COMPOSITION FOR USE IN COMPRESSION-IGNITION ENGINES

(75) Inventors: Luis Pablo Fidel Dancuart Kohler, Sasolburg (ZA); Thabiet Booley, Johannesburg (ZA); Delanie Lamprecht, Vanderbijlpark (ZA)

(73) Assignee: Sasol Technology (Pty) Ltd, Johannesburg (ZA)

( * ) Notice: Subject to any disclaimer, the term of this patent is extended or adjusted under 35 U.S.C. 154(b) by 942 days.

(21) Appl. No.: 11/280,508

(22) Filed: Nov. 15, 2005

(65) Prior Publication Data

US 2006/0122442 A1 Jun. 8, 2006

Related U.S. Application Data

(63) Continuation-in-part of application No. PCT/ZA2004/000054, filed on May 19, 2004.

(30) Foreign Application Priority Data

May 19, 2003 (ZA) ..... 2003/3844

(51) Int. Cl.
*C10L 1/08* (2006.01)

(52) U.S. Cl. ..... 208/15; 208/950; 585/14; 44/300

(58) Field of Classification Search ..... 585/14; 208/15, 950

See application file for complete search history.

(56) References Cited

U.S. PATENT DOCUMENTS

| | | | | |
|---|---|---|---|---|
| 6,607,568 | B2 * | 8/2003 | Wittenbrink et al. | 44/451 |
| 6,663,767 | B1 * | 12/2003 | Berlowitz et al. | 208/15 |
| 6,709,569 | B2 * | 3/2004 | Moore et al. | 208/58 |
| 6,755,961 | B1 * | 6/2004 | Berlowitz et al. | 208/15 |
| 6,864,398 | B2 * | 3/2005 | O'Rear | 585/324 |
| 7,033,484 | B2 * | 4/2006 | Bacha et al. | 208/14 |
| 7,156,978 | B2 * | 1/2007 | Benazzi et al. | 208/78 |
| 7,179,364 | B2 * | 2/2007 | O'Rear et al. | 208/15 |
| 7,271,304 | B2 * | 9/2007 | Du Toit | 585/329 |
| 7,374,657 | B2 * | 5/2008 | Miller et al. | 208/14 |
| 7,390,397 | B2 * | 6/2008 | Lamprecht et al. | 208/308 |
| 7,479,168 | B2 * | 1/2009 | O'Rear et al. | 44/412 |
| 7,608,181 | B2 * | 10/2009 | O'Rear | 208/15 |
| 2003/0085153 | A1 | 5/2003 | O'Rear | |

FOREIGN PATENT DOCUMENTS

| | | |
|---|---|---|
| WO | WO 00/20534 A | 4/2000 |
| WO | WO 01/83406 A | 11/2001 |

OTHER PUBLICATIONS

International Preliminary Report on Patentability for Corresponding PCT Application PCT/ZA04/00054.

* cited by examiner

*Primary Examiner* — Ellen McAvoy

(74) *Attorney, Agent, or Firm* — Knobbe Martens Olson & Bear LLP

(57) ABSTRACT

The invention provides a hydrocarbon composition for use in CI engines, said composition comprising a blend of hydrocarbons derived from a LTFT and from a HTFT process, said LTFT derived hydrocarbon being blended with said HTFT derived hydrocarbon in a volumetric ratio of from 1:20 to 20:1. The invention further provides a process for the production of the hydrocarbon composition and a the fuel composition including, in addition to the hydrocarbon composition, one or more component selected from the group including a crude oil derived diesel fuel, a crude oil derived naphtha, a lubricant or light cycle oil (LCO).

15 Claims, 8 Drawing Sheets

HYDROCARBON COMPOSITION FOR USE IN COMPRESSION-IGNITION ENGINES

RELATED APPLICATIONS

This application is a continuation-in-part, under 35 U.S.C. §120, of International Patent Application No. PCT/ZA2004/000054, filed on May 19, 2004 under the Patent Cooperation Treaty (PCT), which was published by the International Bureau in English on Nov. 25, 2004, which designates the U.S. and claims the benefit of South African Provisional Patent Application No. 2003/3844, filed May 19, 2003, the disclosures of which are hereby incorporated by reference in their entireties and are made a portion of this application.

FIELD OF THE INVENTION

The invention relates to a hydrocarbon composition for use in Compression Ignition (CI) engines and to a process related to its preparation.

BACKGROUND TO THE INVENTION

There has been considerable discussion within the European Union (EU) since the late eighties on strategies and programmes to improve air quality. The EU motor vehicle emission regulations and fuel specifications subsequently became tighter with current EURO 3 emission limits for carbon monoxide (CO), hydrocarbons (HC)+nitrogen oxides (NOx) and particulate matter (PM) of 0.64 g/km, 0.56 g/km and 0.05 g/km respectively for passenger vehicles. Fuel with low sulphur and aromatic contents would improve PM emissions. Although fuel sulphur does not influence NOx emissions directly, its elimination from the fuel enables the use of NOx after-treatment methods in new vehicles. Californian Air Resources Board (CARB) diesel and Swedish Environmental Class 1 (EC1) diesel are examples of fuels with a low sulphur and low polycyclic aromatic hydrocarbon (PAH) content that are available in the market.

The highly paraffinic related properties of Sasol Slurry Phase Distillate™ (Sasol SPD™) Low Temperature Fischer-Tropsch (LTFT) derived diesel, also known as Gas-to-Liquid (GTL) diesel, such as high H:C ratio, high cetane number and low density together with virtually zero-sulphur and very low aromatics content give Sasol SPD™ diesel its very good emission performance advantage over crude oil-derived diesel. Compared to CARB diesel and Swedish EC1 diesel, Sasol SPD™ diesel has the lowest regulated and unregulated exhaust emissions.

The LTFT process is a well known process in which synthesis gas, a mixture of gases including carbon monoxide and hydrogen, are reacted over an iron, cobalt, nickel or ruthenium containing catalyst to produce a mixture of straight and branched chain hydrocarbons ranging from methane to waxes with molecular masses above 1400 and smaller amounts of oxygenates. The LTFT process may be derived from coal, natural gas, biomass or heavy oil streams as feed. While the term Gas-to-Liquid (GTL) process refers to schemes based on natural gas, i.e. methane, to obtain the synthesis gas, the quality of the synthetic products is essentially the same once the synthesis conditions and the product work-up are defined. As a matter of reference, the Sasol SPD™ process is a well known LTFT scheme and is also one of the leading GTL conversion technologies.

Some reactors for the production of heavier hydrocarbons using the LTFT process are slurry bed or tubular fixed bed reactors, while operating conditions are generally in the range of 160-280° C., in some cases in the 210-260° C. range, and 18-50 bar, in some cases between 20-30 bar. The molar ratio of Hydrogen to Carbon Monoxide in the synthesis gas may be between 1.0 and 3.0, generally between 1.5 and 2.4.

The LTFT catalyst may comprise active metals such as iron, cobalt, nickel or ruthenium. While each catalyst will give its own unique product slate, in all cases it includes some waxy, highly paraffinic material which needs to be further upgraded into usable products. The FT products are typically hydroconverted into a range of final products, such as middle distillates, naphtha, solvents, lube oil bases, etc. Such hydroconversion, which usually consists of a range of processes such as hydrocracking, hydrotreatment and distillation, can be termed a FT products work-up process.

The complete process can include gas reforming which converts natural gas to synthesis gas ($H_2$ and CO) using well-established reforming technology. Alternatively, synthesis gas can also be produced by gasification of coal or suitable hydrocarbonaceous feedstocks like petroleum based heavy fuel oils. Other products from this unit include a gas stream consisting of light hydrocarbons, a small amount of unconverted synthesis gas and a water stream. The waxy hydrocarbon stream is then upgraded in the third step to middle distillate fuels such as diesel, kerosene and naphtha. Heavy distillates are hydrocracked and olefins and oxygenates are hydrogenated to form a final product that is highly paraffinic.

As it is the case with the LTFT process, the High Temperature Fischer-Tropsch (HTFT) process also makes use of the FT reaction albeit at a higher process temperature. A typical catalyst for HTFT process, and the one considered herebelow, is iron based.

Known reactors for the production of heavier hydrocarbons using the HTFT process are the circulating bed system or the fixed fluidized bed system, often referred in the literature as Synthol processes. These systems operate at temperatures in the range 290-360° C., and typically between 310-340° C., and at pressures between 18-50 bar, in some cases between 20-30 bar. The molar ratio of Hydrogen to Carbon Monoxide in the synthesis gas is essentially between 1.0 and 3.0, generally between 1.5 and 2.4.

Products from the HTFT process are somewhat lighter than those derived from the LTFT process and, as an additional distinction, contain a higher proportion of unsaturated species.

The HTFT process is completed through various steps which include natural gas reforming or gasification of coal or suitable hydrocarbonaceous feedstocks like petroleum based heavy fuel oils to produce synthesis gas ($H_2$ and CO). This is followed by the HTFT conversion of synthesis gas in a reactor system like the Sasol Synthol or the Sasol Advanced Synthol. One of the products from this synthesis is an olefinic distillate, also known as Synthol Light Oil (SLO). This SLO is fractionated into naphtha and distillate fractions. The distillate fraction of SLO is further hydrotreated and distilled to produce at least two distillates boiling in the diesel range: a Light and a Heavy product. The former is also known as Hydrotreated Distillate (DHT) diesel and the latter as a Distillate Selective Cracked (DSC) heavy diesel.

The HTFT derived DHT diesel also contains ultra-low sulphur levels, has a cetane number greater than fifty and a density that meets current European National Specifications for Special Low Sulphur and Low Aromatics Grade Diesel Fuel with a mono-aromatic content of ±25 vol %.

Description of these two FT processes, LTFT and HTFT, may be found in Appl Ind Catalysis vol. 2 chapter 5 pp 167-213 (1983), amongst others.

Material compatibility in fuel systems is a concern whenever fuel composition changes. Exposure of an elastomer that has been exposed to high aromatic fuel and then to low aromatic, severely hydrotreated fuel, may cause leaching of absorbed aromatics, causing it to shrink. If the elastomer is still pliable, this shrinkage will not cause a leak, but an aged elastomer will loose its elasticity and a leak may occur. It is therefore not the low aromatic hydrocarbon diesel that causes fuel system leaks, but the combination of a change from higher to lower aromatics fuel. The above was confirmed with the ageing of nitrile rubber and Viton® in LTFT derived diesel and US No. 2-D diesel without pre-conditioning.

SUMMARY OF THE INVENTION

Thus, according to a first aspect of the invention, there is provided a hydrocarbon composition for use in CI engines, said composition comprising a blend of hydrocarbons derived from a LTFT and from a HTFT process, said LTFT derived hydrocarbon being blended with said HTFT derived hydrocarbon in a volumetric ratio of from 1:20 to 20:1.

The LTFT:HTFT ratio may be from 1:8 to 8:1.

The LTFT:HTFT ratio may be from 1:4 to 4:1.

The LTFT:HTFT ratio may be from 1:2 to 2:1.

The LTFT:HTFT ratio may be 1:1.

The hydrocarbon composition may have an aromatics content of above 1% by mass, typically above 3% by mass.

The hydrocarbon composition may have an aromatics content in excess of 9% by mass.

The aromatics content comprises mostly the least harmful mono-aromatics species which are derived primarily from the HTFT component of the blend.

The hydrocarbon composition may have a density of above 0.78 kg/m$^3$@15° C.

The net heating value of the hydrocarbon composition may be between 43.0 and 44.0 MJ/kg on a mass basis or 33.5 to 35.0 MJ/l on a volume basis.

The hydrogen content may be from 13.5 mass % to 15 mass %

The hydrogen to carbon ratio of the hydrogen composition may be from 1.8 mol/mol to 2.2 mol/mol The hydrocarbon composition may have an initial boiling point as measured according to the ASTM D86 method above 150° C. and T95 below 360° C.

The hydrocarbon composition may have a final boiling point as measured according to the ASTM D86 method of below 390° C.

The hydrocarbon composition may have a bromine number below 10.0 g Br/100 g.

The hydrocarbon composition may have an acid number below 0.006 mg KOH/g.

The hydrocarbon composition may have an Oxidation Stability below 0.7 mg/100 ml insolubles formed.

The hydrocarbon composition may be stable over two years with the total amount of insolubles formed being less than 1.35 mg/100 ml and an acid number less than 0.02 mgKOH/g.

The hydrocarbon composition may have a water content below 0.005% on a volume basis.

The hydrocarbon composition may be benign to elastomers used in CI engines and which have been exposed to crude oil derived diesel fuels.

The invention extends to a fuel composition including from 1% to 99% by volume of a hydrocarbon composition as described above.

The fuel composition may include 15% by volume of the hydrocarbon composition as described above.

The fuel composition may be a CI engine fuel composition.

According to another aspect of this invention, the fuel composition may include, in addition to the hydrocarbon composition, one or more component selected from the group including a crude oil derived diesel fuel, a crude oil derived naphtha, a lubricant or light cycle oil (LCO).

According to yet a further aspect of the invention there is provided a process for the production of a hydrocarbon composition for use in CI engines, said process including the steps of:— a. producing one or more synthesis gas products from solid, liquid or gaseous carbonaceous feedstock by one or more synthesis gas production process;

b. optionally, blending two or more synthesis gas products to produce a synthesis gas blend for a synthesis gas reaction process;

c. processing the synthesis gas product or synthesis gas blend by a High Temperature Fischer-Tropsch synthesis process to produce synthetic hydrocarbon and water;

d. processing synthesis gas or synthesis gas blend by a Low Temperature Fischer-Tropsch synthesis process to produce synthetic hydrocarbon and water;

e hydroconverting at least a fraction of the hydrocarbon of step c. to produce one or more HTFT process derived hydrocarbons in the boiling range 150° C. to 390° C. for blending to produce a hydrocarbon composition for use as a fuel in a CI engine;

f. hydroconverting at least a fraction of the hydrocarbon of step d. to produce one or more LTFT process derived hydrocarbons in the boiling range 150° C. to 390° C. for blending to produce a hydrocarbon composition for use as a fuel in a CI engine; and g blending the hydrocarbons produced in steps e and f to form the hydrocarbon composition.

The hydrocarbon composition may be prepared by blending a LTFT process derived hydrocarbon with a HTFT derived hydrocarbon.

The process may include the step of blending two or more of the hydrocarbons in the boiling range 150° C. to 390° C. to produce the hydrocarbon composition for use in CI engines.

The synthesis gas may be produced by reforming natural gas.

The synthesis gas may be produced by gasification of suitable hydrocarbon feed stock, for example, coal.

The synthetic hydrocarbon may be an olefinic hydrocarbon.

The synthetic hydrocarbon may be a hydrocarbon suited for conversion to distillate range hydrocarbons.

Two of the hydrocarbons produced by the hydrocarbon processes may be a DHT diesel and a Sasol SPD™ diesel.

The DHT diesel is an example of HTFT derived hydrocarbons and GTL diesel is an example of LTFT derived hydrocarbons.

The DHT diesel and Sasol SPD™ diesel may be blended at a ratio from 1:100 to 100:1 on a volume basis.

The DHT diesel and Sasol SPD™ diesel may be blended at a ratio from 1:40 to 40:1 on a volume basis.

The DHT diesel and Sasol SPD™ diesel may be blended at a ratio from 1:20 to 20:1 on a volume basis.

The synthesis gas feeds produced from the reforming of natural gas and gasification may be blended prior to synthesis gas reaction process in a ratio of 1:100 to 100:1 on a volume basis.

The synthesis gas feeds produced from the reforming of natural gas and gasification may be blended prior to synthesis gas reaction process in a ratio of 1:40 to 40:1 on a volume basis.

The LTFT synthetic hydrocarbon and HTFT synthetic hydrocarbon produced from the LTFT synthesis gas reaction process and HTFT synthesis gas reaction process respectively may be blended prior to hydroconversion in a ratio of 1:100 to 100:1 on a volume basis.

The LTFT synthetic hydrocarbon and HTFT synthetic hydrocarbon produced from the LTFT synthesis gas reaction process and HTFT synthesis gas reaction process respectively may be blended prior to hydroconversion in a ratio of 1:40 to 40:1 on a volume basis.

DETAILED DESCRIPTION OF THE PREFERRED EMBODIMENTS

Figure 1:
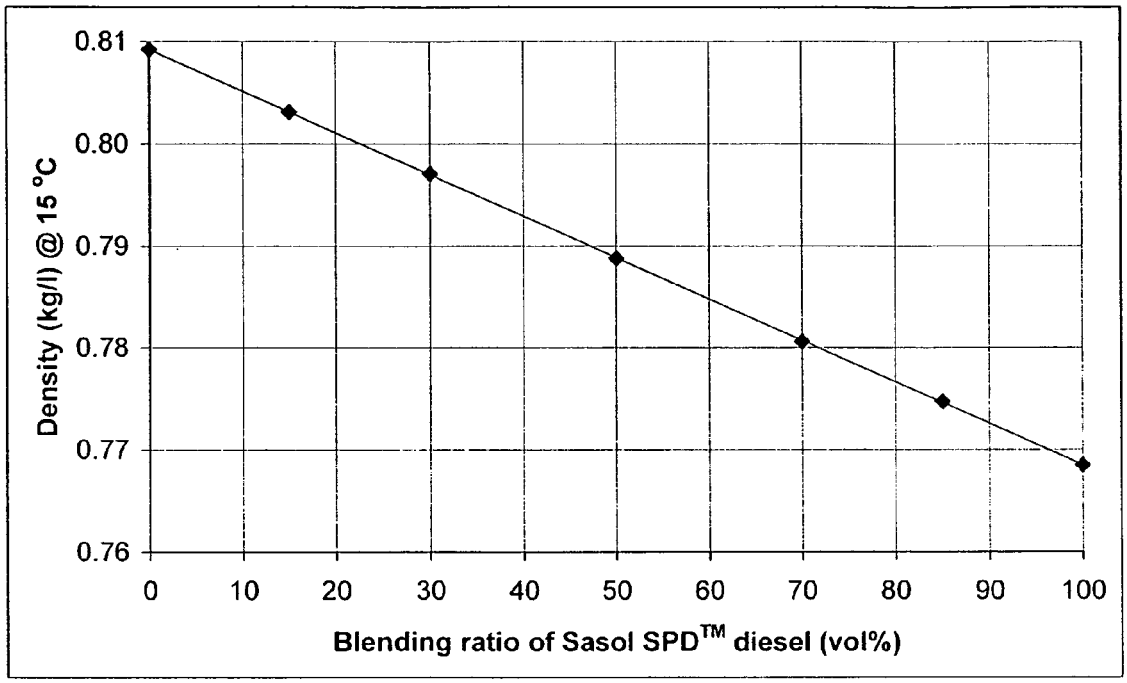
FIG. 1 shows a linear relationship of fuel density with various Sasol SPD™ diesel-DHT diesel blends.

The hydrocarbon composition of the invention was prepared by blending a LTFT process derived hydrocarbon with a HTFT derived hydrocarbon.

In the examples that follow the following abbreviations have been used:

DHT—refers to the hydroconversion process used primarily to upgrade the distillate contained in the HTFT SLO.

DHT Diesel—it refers to a HTFT process derived hydrocarbon which has been hydrotreated.

GTL—This is a LTFT process based on natural gas that optionally can also make use of alternative hydrocarbonaceous feeds to produce synthesis gas.

Sasol Slurry Phase Distillate™ (Sasol SPD™) diesel or GTL diesel—it refers to a LTFT process derived hydrocarbon that is fully hydroconverted.

Two base fuels were used to prepare five hydrocarbon compositions including Sasol SPD™ diesel and DHT diesel for this investigation.

The experimental blends contained mixtures of 15%, 30%, 50%, 70% and 85% by volume Sasol SPD™ diesel with the DHT diesel. The properties of the neat Sasol SPD™ diesel and DHT diesel and blends thereof are summarised in Table 1, 2, 3 and 4. An example of the fuel properties of the Fischer-Tropsch hydrocarbon compositions of the invention and crude oil derived diesel (US 2-D diesel) blends are also tabulated as illustrated in Table 5.

TABLE 1

Selected properties of Sasol SPD ™ - DHT Hydrocarbon Compositions

| Analysis | Units | Method | DHT diesel | 15% Sasol SPD ™ | 30% Sasol SPD ™ | 50% Sasol SPD ™ | 70% Sasol SPD ™ | 85% Sasol SPD ™ | Sasol SPD ™ diesel |
|---|---|---|---|---|---|---|---|---|---|
| Colour | | ASTM D1500 | 1 | 1 | 1 | 1 | 1 | <1 | <1 |
| Appearance | | Caltex CMM76 | 1 | 1 | 1 | 1 | 1 | 1 | 1 |
| Density @ 15° C. | kg/l | ASTM D4052 | 0.809 | 0.803 | 0.797 | 0.789 | 0.781 | 0.775 | 0.769 |
| Distillation | | ASTM D86 | | | | | | | |
| IBP | ° C. | | 184 | 180 | 166 | 159 | 153 | 152 | 151 |
| T10 | ° C. | | 208 | 205 | 200 | 195 | 189 | 184 | 182 |
| T50 | ° C. | | 239 | 242 | 242 | 243 | 245 | 246 | 249 |
| T95 | ° C. | | 363 | 359 | 351 | 343 | 336 | 330 | 325 |
| FBP | ° C. | | 385 | 385 | 379 | 367 | 358 | 345 | 334 |
| Flash point | ° C. | ASTM D93 | 78 | 74 | 72 | 66 | 63 | 60 | 58 |
| Viscosity @ 40° C. | cSt | ASTM D445 | 2.14 | 2.11 | 2.10 | 2.07 | 2.03 | 2.01 | 1.97 |
| CFPP | ° C. | IP 309 | 0 | −1 | −3 | −6 | −11 | −20 | −19 |
| Water | vol % | ASTM D1744 | 0.003 | 0.003 | 0.004 | 0.003 | 0.003 | 0.003 | 0.003 |
| Sulphur | mass % | ASTM D5453 | 0.0003 | 0.0002 | 0.0002 | <0.0001 | <0.0001 | <0.0001 | <0.0001 |
| Acid number | mgKOH/g | ASTM D664 | 0.004 | 0.005 | 0.003 | 0.004 | 0.002 | 0.002 | 0.001 |
| Total Aromatics (HPLC) | Mass % | | 23.88 | 20.32 | 16.76 | 12.01 | 7.26 | 3.70 | 0.14 |
| Cetane Number | | ASTM D613 | 57 | 59 | 61 | 66 | 67 | 69 | 73 |
| Oxidation Stability | mg/100 ml | ASTM D2274 | 0.5 | 0.5 | 0.5 | 0.4 | 0.3 | 0.3 | 0.6 |

TABLE 1-continued

| Selected properties of Sasol SPD ™ - DHT Hydrocarbon Compositions | | | | | | | | | |
|---|---|---|---|---|---|---|---|---|---|
| Analysis | Units | Method | DHT diesel | 15% Sasol SPD ™ | 30% Sasol SPD ™ | 50% Sasol SPD ™ | 70% Sasol SPD ™ | 85% Sasol SPD ™ | Sasol SPD ™ diesel |
| Bromine Number | gBr/100 g | IP 129 | 9.4 | 8.2 | 6.7 | 5.4 | 3.2 | 1.9 | 0.6 |
| Long term Storage stability Acid number | mgKOH/g | ASTM D4625 | 0.008 | 0.007 | 0.008 | 0.008 | 0.006 | 0.009 | 0.013 |
| Total insolubles | mg/100 ml | | 0.68 | 0.63 | 0.45 | 0.96 | 1.31 | 0.53 | 0.35 |

TABLE 2

| Heating values of DHT-Sasol SPD ™ Hydrocarbon Compositions | | | | | | | |
|---|---|---|---|---|---|---|---|
| | DHT diesel | 15% Sasol SPD ™ | 30% Sasol SPD ™ | 50% Sasol SPD ™ | 70% Sasol SPD ™ | 85% Sasol SPD ™ | Sasol SPD ™ diesel |
| Gross heating value (MJ/kg) | 46.037 | 46.248 | 46.331 | 46.816 | 46.845 | 46.954 | 46.964 |
| Net Heating Value (MJ/kg) | 43.164 | 43.368 | 43.422 | 43.775 | 43.774 | 43.818 | 43.787 |
| Hydrogen content (mass %) | 13.54 | 13.57 | 13.71 | 14.33 | 14.47 | 14.78 | 14.97 |
| Density @ 15° C. (kg/l) | 0.8092 | 0.8031 | 0.7971 | 0.7888 | 0.7806 | 0.7747 | 0.7685 |
| Net heating value (MJ/l) | 34.928 | 34.829 | 34.611 | 34.530 | 34.170 | 33.946 | 33.651 |
| H:C ratio (mol/mol) | 1.87 | 1.87 | 1.90 | 1.98 | 2.01 | 2.06 | 2.10 |

TABLE 3

| High-frequency reciprocating rig (HFRR) and scuffing load ball-on-cylinder (SL BOCLE) lubricity evaluation of Sasol SPD ™ - DHT Hydrocarbon Compositions | | | | | | | |
|---|---|---|---|---|---|---|---|
| | DHT diesel | 15% Sasol SPD ™ | 30% Sasol SPD ™ | 50% Sasol SPD ™ | 70% Sasol SPD ™ | 85% Sasol SPD ™ | Sasol SPD ™ diesel |
| HFRR (WSD μm) | 547 | 549 | 552 | 556 | 560 | 612 | 617 |
| SL BOCLE load (g) | 4400 | 2800 | 2800 | 2800 | 2500 | 1700 | 1500 |

Another property which was considered was the heating value of the hydrocarbon compositions. There are two values, Gross (or High) and Net (or Low) commonly quoted which vary according to whether the water content in the products of combustion is considered to be in liquid or gaseous form. The gross heating values ($Q_{gross}$) of the Sasol SPD™ diesel—DHT diesel blends were determined according to the American Society for Testing and Material (ASTM) D240 test method. The net heating value ($Q_{nett}$) per mass was calculated using the following equation:

$$Q_{nett}^{25^\circ C.}=Q_{gross}^{25^\circ C.}-0.2122\times H(\text{mass}\%)$$

where the difference between the two values is a function of the latent heat of condensation of water and hydrogen content of the composition. Table 2 shows these results.

The issue of lubricity is pertinent in the case of severely hydrotreated low-sulphur diesel. There are two common methods of assessing lubricity; namely the Scuffing Load Ball-On-Cylinder (SL BOCLE) method and the HFRR. Lubricity evaluation tests of the various hydrocarbon compositions are shown in Table 3 and conducted according to both the ASTM D6078 and ASTM D6079 test methods.

Finally, the long-term storage stability of the neat Sasol SPD™ diesel and DHT diesel and hydrocarbon compositions comprising blends thereof was investigated according to the standard ASTM D4625 test method. The acid number and total insolubles formed over a period of 24 weeks at 43° C. were measured and reported to be smaller than 0.02 mgKOH/g and 1.35 mg/100 ml respectively.

The Bromine number (IP 129 Procedure), the Acid number (ASTM D694 test method), Oxidation Stability (ASTM D2274) and the water content (ASTM D1744 test method) of the fuel and the proposed blends were also measured and the results are shown in Table 1. It is evident that in all blends of DHT diesel and Sasol SPD™ diesel, the following measured quality characteristics apply:

1—Bromine number below 10.0 g Br/100 g. This is an indication of the residual olefin in the product. Olefinic compounds are susceptible to gum formation and are less stable.

2—Acid number below 0.004 mg KOH/g. This is an indication of, mostly, the residual organic acids and alcohols in the product and the tendency of the fuel to corrode.

3—Oxidation Stability below 0.6 mg/100 ml. Oxygen stability is tested through the calculation of the amount of insolubles formed in the presence of oxygen. This is an indication of the behaviour of the fuel when exposed to atmospheric oxygen under standard storage conditions and measures the fuel's resistance to degradation.

4—Water content below 0.004% on a volume basis. This is an indication of the quality of the final fractionated product. Entrained water can form stable emulsions and suspended matter, which cloud plug filters.

Characterisation and quantification of the composition of the neat Sasol SPD™ diesel and DHT diesel was obtained through Fluorescent Indicator Adsorption (FIA) and High Performance Liquid Chromatography (HPLC) (see Table 4).

TABLE 4

Sasol SPD ™ diesel and DHT diesel hydrocarbon components

| Component | Sasol SPD ™ | DHT |
|---|---|---|
| Total Aromatics (vol %) | <1 | 24 |
| Mono-aromatics (mass %) | 0.1439 | 23.658 |
| Dicyclic-aromatics (mass %) | <0.0001 | 0.118 |
| Polycyclic-aromatics (mass %) | <0.0001 | 0.104 |
| Olefins (vol %) | 2 | 1 |
| Paraffins (vol %) | 98 | 75 |

The diesel properties that are most important to ensure good engine performance and which influence emissions include cetane number, aromatics, density, heat content, distillation profile, sulphur, viscosity, and cold flow characteristics. These properties, among others, will be discussed below for the hydrocarbon compositions.

DENSITY—Diesel density specifications are tending to become tighter. This is due to the conflicting requirements of a lower density fuel to reduce particulate matter emissions, whilst retaining a minimum density to ensure adequate heat content, which relates to fuel economy. Increasing ratios of DHT to Sasol SPD™ diesel would increase the hydrocarbon composition density, even beyond the minimum requirement of 0.800 kg/l, but not higher than its upper specified limit of 0.845 kg/l@ 15° C. (see FIG. 1).

FIG. 1 shows a linear relationship of fuel density with various Sasol SPD™ diesel—DHT diesel blends.

HEATING VALUES—Fischer-Tropsch synthetic fuels have much higher gravimetrical heating values than severely hydrotreated crude derived diesel and lower net volumetric heating values. Aromatic compounds have a much higher density and volumetric heating value than naphthenes or paraffins with the same carbon number. The net volumetric heating value of the hydrocarbon composition increases with increasing DHT diesel content. The net volumetric heating value of the composition containing equal amounts of Sasol SPD™ and DHT is 34.5 MJ/l (see FIG. 2).

Figure 2:
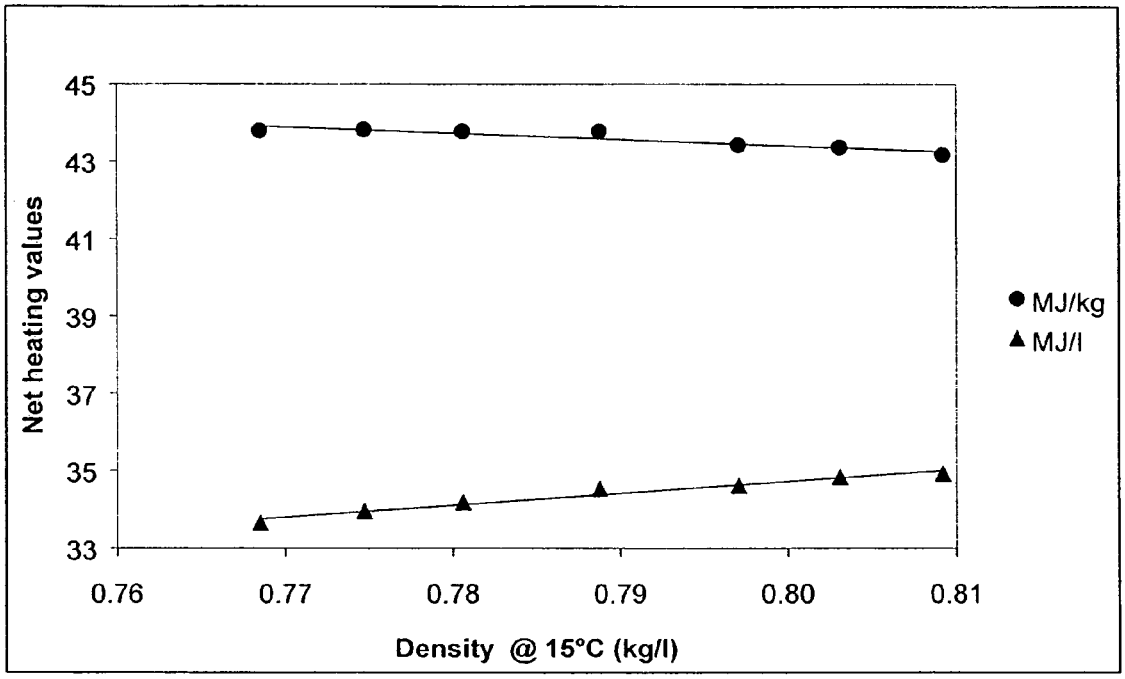
FIG. 2 shows gravimetrical and volumetric net heating values of hydrocarbon compositions of the invention.

FIG. 2 shows gravimetrical and volumetric net heating values of hydrocarbon compositions of the invention VISCOSITY—A fuel viscosity that is excessively low causes the injection spray not to penetrate far enough into the cylinder and could cause idling and hot start problems whereas high viscosity reduces fuel flow rates. All the hydrocarbon compositions described above are within the EN 590: 1999 Diesel Specification viscosity requirement.

DISTILLATION PROFILE—DHT diesel has a much higher initial boiling point (IBP) than Sasol SPD™ diesel (see DHT diesel distillation profile in FIG. 3) and therefore a higher flash point than that of Sasol SPD™ diesel. The hydrocarbon compositions of the invention comply with the EN 590:1999 T95 Diesel Specification. Fuels with higher end points tend to have worse cold flow properties than fuels with lower final boiling points and therefore the low maximum T95 limit for arctic grade diesel. Sasol SPD™ diesel on the other hand has good cold flow properties as well as a high cetane number because of the predominately mono- and to a lesser extent di-methyl branching of the paraffins. Sasol SPD™ diesel improves the cold flow properties of DHT diesel with its higher T95 to meet the European Summer Climate Grade CFPP values of −5° C. and −10° C.

Figure 3:
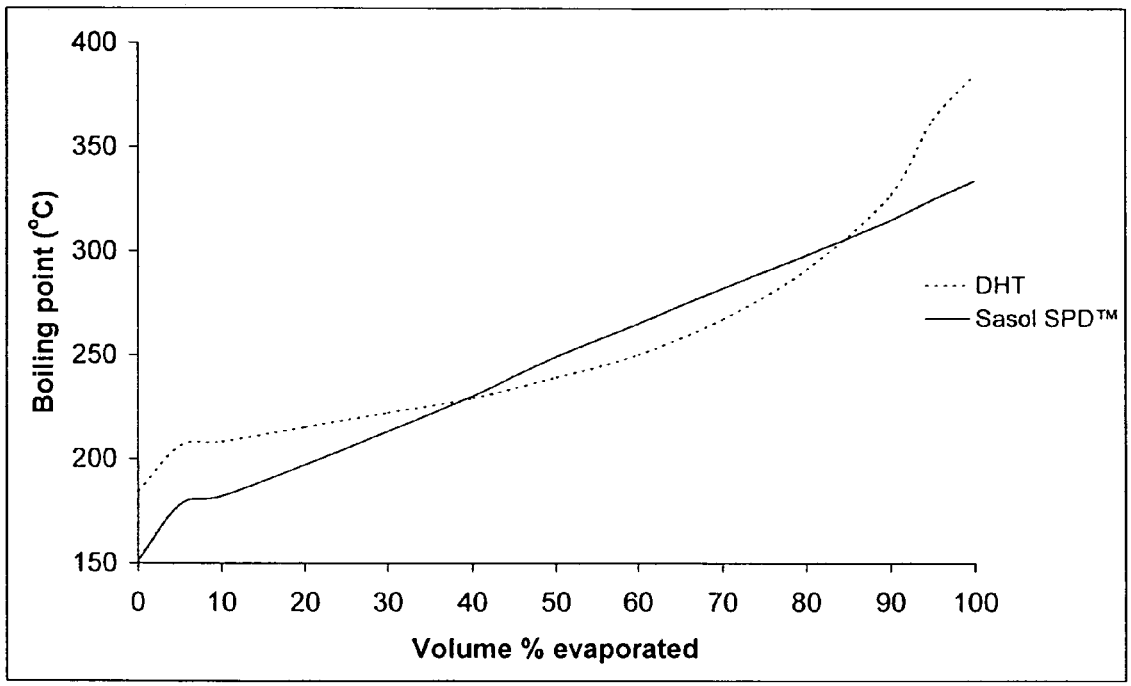
FIG. 3 shows a distillation profile of Sasol SPD™ diesel and DHT diesel.

FIG. 3 shows a distillation profile of Sasol SPD™ diesel and DHT diesel.

Figure 4:
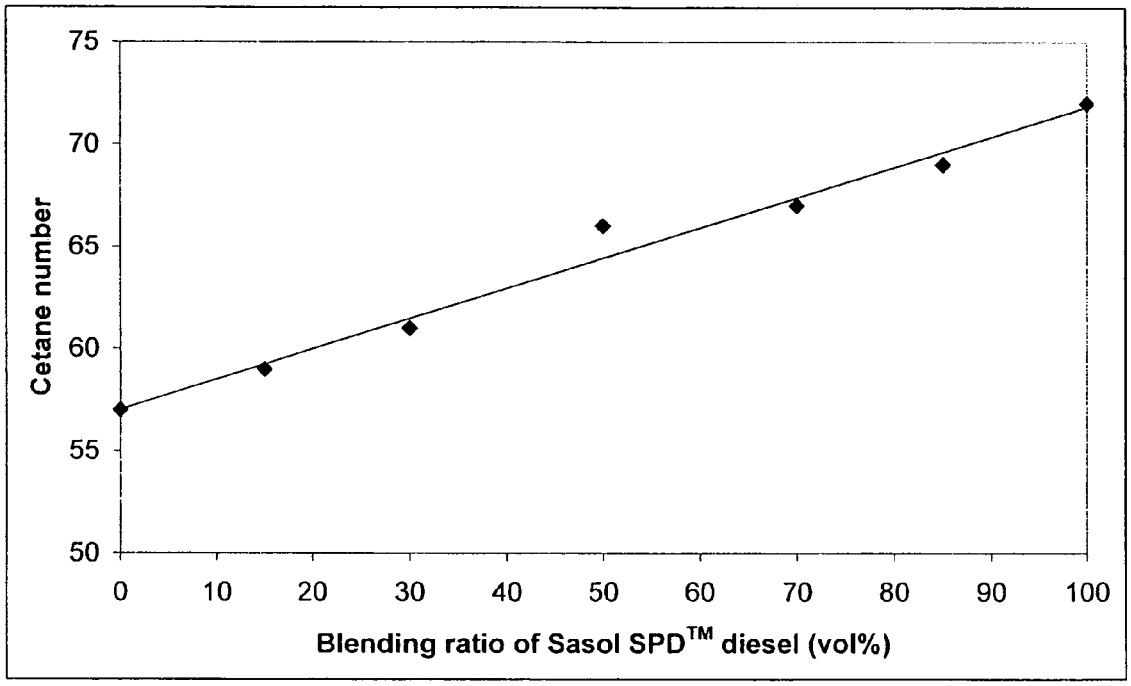
FIG. 4 shows a linear cetane number relationship of hydrocarbon compositions of the invention.

CETANE NUMBER—Sasol SPD™ diesel, with a cetane number rating of 72, improves the 57 cetane number of DHT diesel linearly (see FIG. 4). Fuels with a high cetane number ignite quicker and hence exhibit a milder uncontrolled combustion because the quantity of fuel involved is less. A reduction of the uncontrolled combustion implies an extension of the controlled combustion, which results in better air/fuel mixing and more complete combustion with lower NOx emissions and better cold start ability. The shorter ignition delay implies lower rates of pressure rise and lower peak temperatures and less mechanical stress. The cetane numbers of the hydrocarbon compositions of the present invention are far beyond all specification requirements.

FIG. 4 shows a linear cetane number relationship of hydrocarbon compositions of the invention.

Other excellent properties of hydrocarbon compositions of the invention include their ultra-low sulphur content (less, than 5 ppm), no unsaturates or polycyclic aromatic hydrocarbons, low bromine number. According to the very low acid number and water content observed, the likelihood of the hydrocarbon compositions of the invention to corrode are very slim.

TABLE 6

Percentage physical property change of new nitrile rubber, pre-conditioned in US 2-D diesel and further exposed to hydrocarbon composition samples.

| Fuel | US No. 2-D | DHT diesel | Sasol SPD ™ diesel | FT blend |
|---|---|---|---|---|
| Mass | 10.01 | 0.60 | −4.12 | −1.50 |
| Thickness | 6.98 | 1.89 | 1.24 | 0.75 |
| Tensile strength | −38.81 | −35.88 | −25.80 | −26.04 |
| Hardness | −10.20 | −5.77 | −2.68 | −4.70 |

Figure 5:
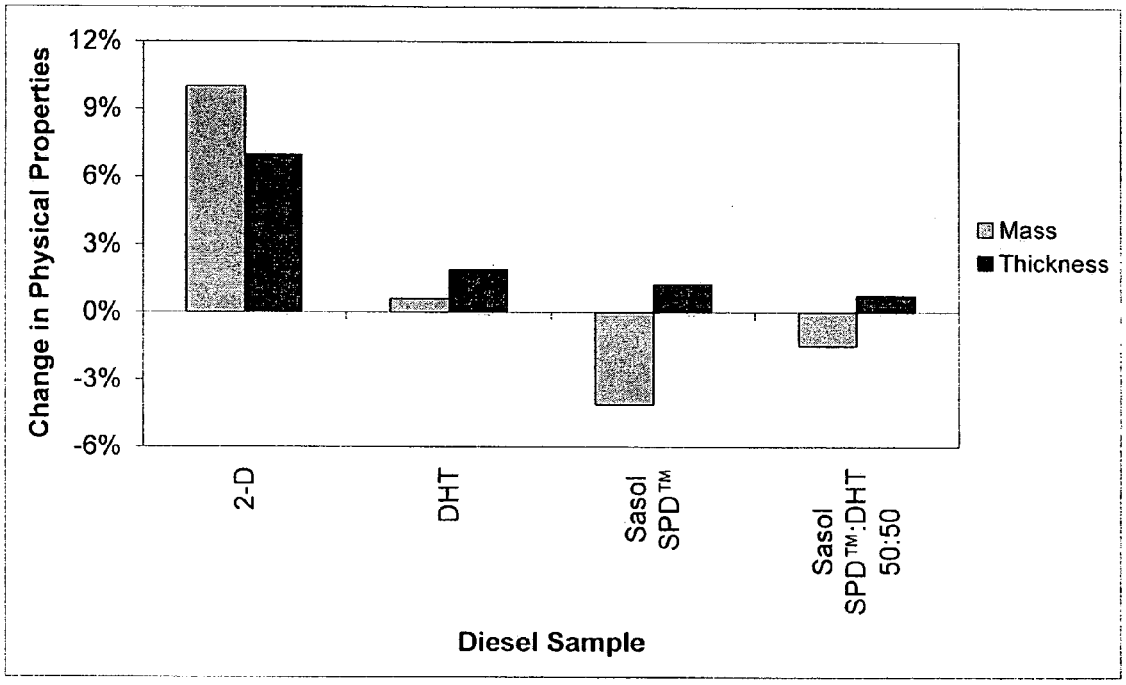
FIG. 5 shows percentage change in mass and thickness of new nitrile rubber dumbbells, pre-conditioned in US No. 2-D and then further aged in a hydrocarbon composition comprising DHT/Sasol SPD™ diesel and US No. 2-D diesel.

MASS AND DIMENSION CHANGE—Ageing of nitrile rubber in the Sasol SPD™ diesel caused the swollen preconditioned dumbbells to shrink and to loose weight (see FIG. 5). This effect was reduced with the blend of DHT and Sasol SPD™ causing the nitrile rubber to return to its original thickness and within 1.5% of its original mass. Exposure of the pre-conditioned nitrile rubber for another 166 hours to US No. 2-D diesel causes a total increase of 10% in the mass of new dumbbells. According to Chemical Resistance Guide for Elastomers II, if loss in dimensions are smaller than 15% from 30 days to one year, the description of attack can still be seen as excellent and little surface deterioration.

FIG. 5 shows percentage change in mass and thickness of new nitrile rubber dumbbells, pre-conditioned in US No. 2-D and then further aged in a hydrocarbon composition comprising DHT/Sasol SPD™ diesel and US No. 2-D diesel.

TENSILE STRENGTH—All the diesel samples softens new elastomers. The Sasol SPD™ diesel hardens the preconditioned nitrile rubber dumbbells and therefore increases its tensile strength (see FIG. 6). The mono-aromatic hydrocarbon content of the DHT diesel reduces the tensile strength of the nitrile rubber to a lesser extent than that of US No. 2-D diesel.

TABLE 5

Selected properties of Sasol SPD ™ - DHT Hydrocarbon Compositions blends with US 2-D diesel

| | | | | Sasol SPD ™:DHT:US 2-D volumetric blend ratio | | | |
|---|---|---|---|---|---|---|---|
| Analysis | Units | Method | US2-D | 0.3:0.7:1 | 0.7:0.3:1 | 1:1:1 | 2:2:1 |
| Density @ 15° C. | kg/l | ASTM D4052 | 0.861 | 0.8293 | 0.8210 | 0.813 | 0.8033 |
| Distillation | | ASTM D86 | | | | | |
| IBP | ° C. | | 147 | 167 | 155 | 156 | 154 |
| T10 | ° C. | | 215 | 206 | 200 | 200 | 198 |
| T50 | ° C. | | 268 | 256 | 257 | 252 | 249 |
| T95 | ° C. | | 340 | 344 | 339 | 342 | 343 |
| FBP | ° C. | | 353 | 372 | 355 | 362 | 363 |
| Flash point | ° C. | ASTM D93 | 69 | 66 | 60 | 67 | 59 |
| Viscosity @ 40° C. | cSt | ASTM D445 | 2.60 | 2.34 | 2.30 | 2.24 | 2.17 |
| CFPP | ° C. | IP 309 | −14 | −7 | −12 | −8 | −7 |
| Sulphur | mass % | ASTM D5453 | 0.04 | 0.021 | 0.021 | 0.014 | 0.0086 |
| Cetane no. | | ASTM D613 | 41 | 52 | 56 | 59 | 62 |
| Lubricity (HFRR) | (WSD μm) | ASTM D6079 | 293 | 423 | 427 | 468 | 503 |
| Total aromatics | mass % | | 34.44 | 25.93 | 21.48 | 19.88 | 16.77 |

ELASTOMER COMPATIBILITY—The effect of mono-aromatics in Sasol SPD™ diesel on the physical properties of seals was studied with a hydrocarbon composition comprising 50 vol % DHT with 50 vol % Sasol SPD™ (FT blend). The physical properties of the untreated elastomers were taken as baseline. The overall change in mass, thickness, tensile strength and hardness of pre-conditioned standard nitrile rubber being exposed to the composition was compared with nitrile rubber being exposed to the base fuels. The nitrile rubber, an acrylonitrile butadiene copolymer, was pre-conditioned in highly aromatic US No. 2-D diesel for 166 hours according to the ASTM test method for Rubber Property—Effect of Liquids (ASTM D471), Vulcanised Rubber and Thermoplastic Elastomers—Tension (ASTM D412) and Durometer Hardness (ASTM D 2240) respectively. Average mass change, change in thickness, tensile strength and hardness of five new dumbbells, pre-conditioned and thereafter exposed to US No. 2-D, Fischer-Tropsch diesel and a blend thereof are tabulated in Table 6.

Figure 6:
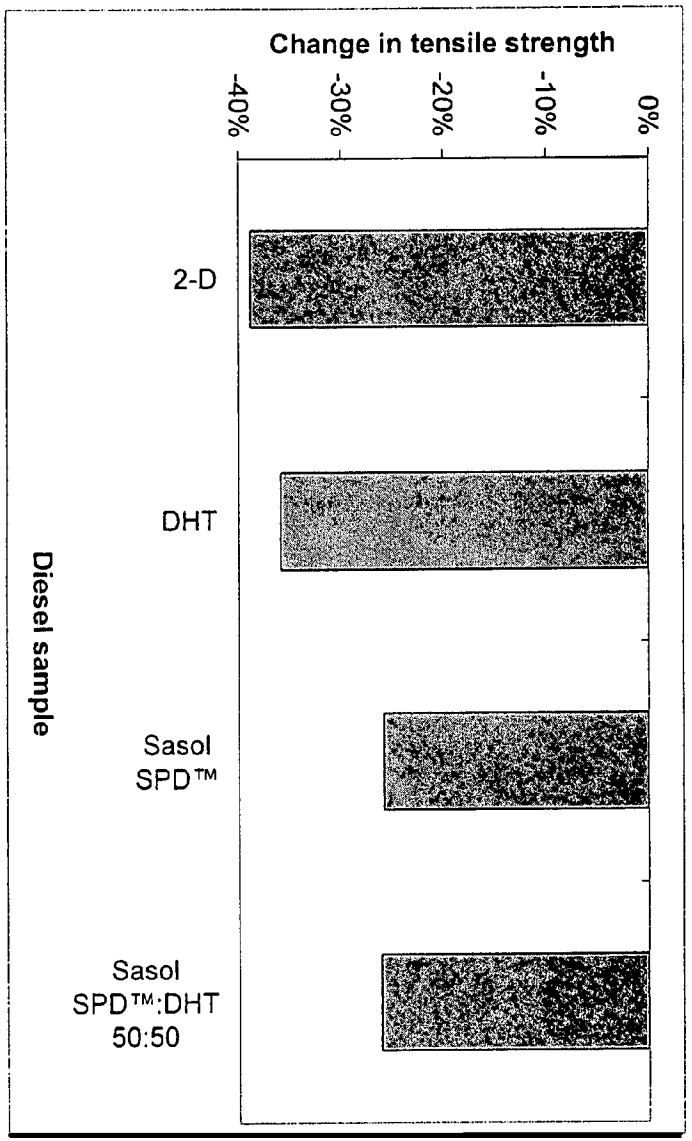
FIG. 6 shows percentage change in tensile strength of nitrile rubber dumbbells, pre-conditioned in US No. 2-D and then further aged in a hydrocarbon composition of the invention and US No. 2-D diesel.

FIG. 6 shows percentage change in tensile strength of nitrile rubber dumbbells, pre-conditioned in US No. 2-D and then further aged in a hydrocarbon composition of the invention and US No. 2-D diesel.

HARDNESS—Exposure of nitrile rubber to the hydrocarbon composition of the invention makes indentation more difficult and hardens the pre-conditioned dumbbells. Continuous exposure of the pre-conditioned dumbbells with US No. 2-D diesel softens it further. The presence of DHT diesel in the Sasol SPD™ diesel reduces its hardening effect on the dumbbells.

Figure 7:
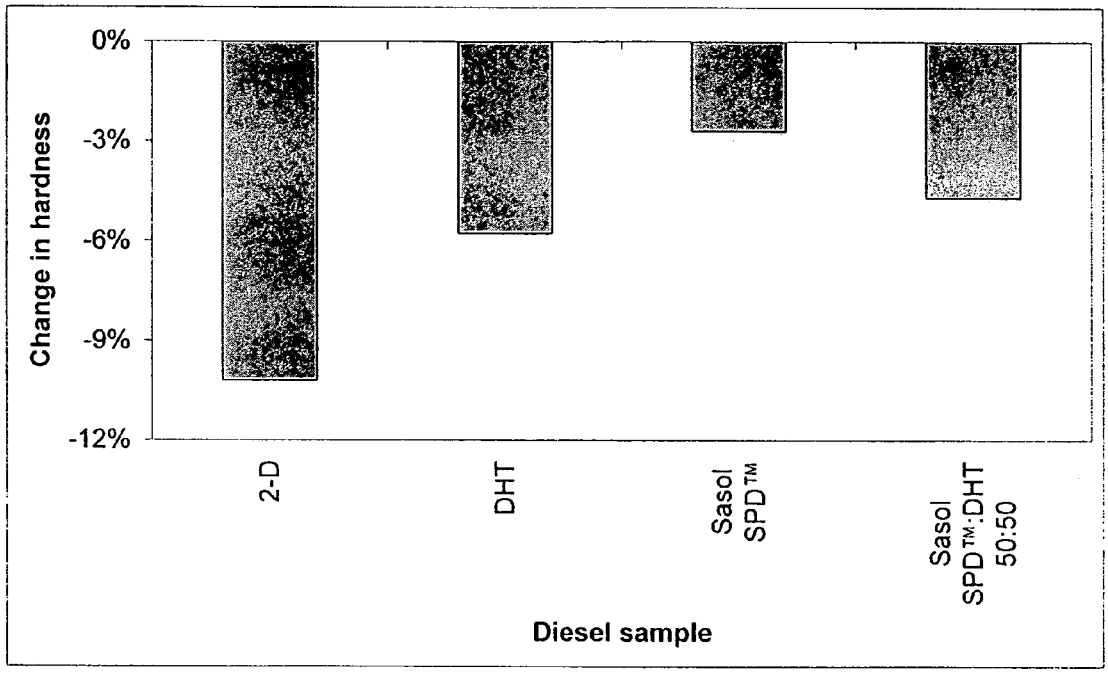
FIG. 7 shows: Percentage change in hardness of nitrile rubber dumbbells, pre-conditioned in US No. 2-D and then further aged in the hydrocarbon composition of the invention and US No. 2-D diesel.

FIG. 7 shows: Percentage change in hardness of nitrile rubber dumbbells, pre-conditioned in US No. 2-D and then further aged in the hydrocarbon composition of the invention and US No. 2-D diesel.

The hydrocarbon compositions of the invention have a very high consistent quality with an ultra-low sulphur content and a high cetane number. These compositions provide future fuel characteristics in a form that is compatible with current infrastructure and technology.

Process Scheme

Figure 8:
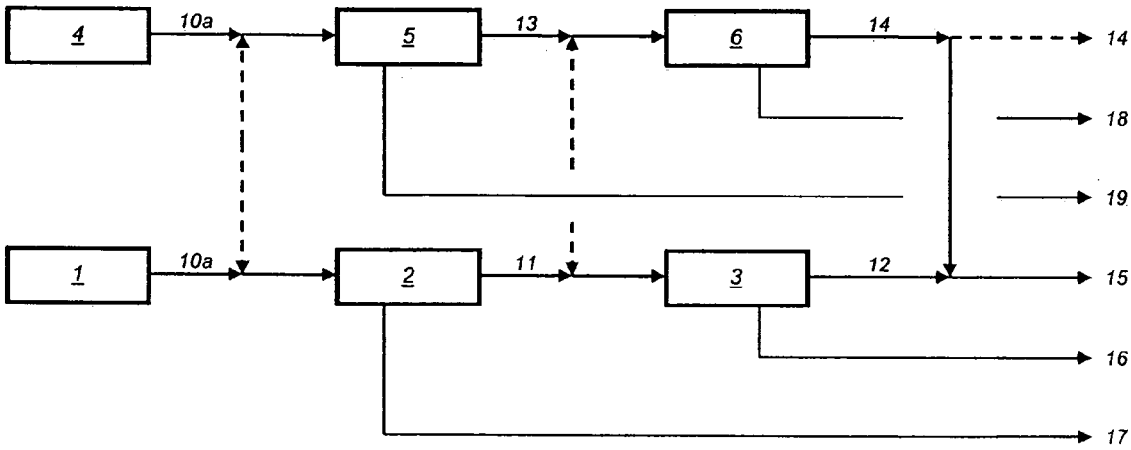
FIG. 8 provides a schematic representation of a process for producing hydrocarbons according to the preferred embodiments.

This process is illustrated in FIG. 8.

Synthesis gas can be produced either using reforming 4 of natural gas or gasification 1 of a suitable hydrocarbonaceous feedstock. The first process option results in synthesis gas 10*a* and the latter 10*b*, two streams possible of being interchangeable and/or manipulated to a required primary composition. This is illustrated by means of the dotted line linking 10*a* and 10*b* in said FIG. 8.

Either synthesis gas or a blend thereof is sent to a HTFT synthesis process 2, resulting in a mixture of synthetic hydrocarbons and water. This is separated into at least two streams: stream 11 is an olefinic distillate and stream 17 which for illustration groups all non-distillate range hydrocarbons which might undergo further processing not shown in this description. Stream 11 is sent to hydroconversion unit 3 to obtain the DHT diesel 12 along with other by-products 16 not specifically defined in this invention but know to a person skilled in the art.

In parallel, another portion of either synthesis gas or a blend thereof is sent to a LTFT synthesis process 5, also resulting in a mixture of synthetic hydrocarbons and water. This is separated into at least two streams. Stream 13 comprises synthetic hydrocarbon species suitable to be hydroconverted in hydroconversion unit 6 to a distillate range Sasol SPD™ diesel 14 and other products that for the purpose of this illustration are lumped as stream 18. Stream 19 from LTFT unit 5 comprises all synthesis products not sent to the hydroconversion unit 6. It will be apparent to a person skilled in the art that this product might be further processed beyond the scope of this invention.

Streams 12—DHT diesel—and 14—Sasol SPD™ diesel—can then be blended resulting in the CI fuel matter of this invention, stream 15. The blending ratio for the two synthetic fuels might be between 1:100 to 100:1, preferably 1:40 to 40:1, and even more preferably 1:20 to 20:1 on a volume basis.

Hydroprocessing to obtain the synthetic distillates can be done in parallel units—as described before—or in a single one to optimize the process. In the latter case, illustrated by the dotted line linking streams 11 and 13 in FIG. 8, the blending ratio for the two synthetic feeds might be between 1:100 to 100:1, preferably 1:40 to 40:1, and even more preferably 1:20 to 20:1 on a volume basis.

It is noted that while the two FT processes can be operated at separate locations respectively, there might be some significant synergy effects in running them together at the same location. These effects include better utilisation of the synthesis gas and integration of process utilities, as well as those derived from the product blend matter of this invention.

What is claimed is:

1. A process for the production of a hydrocarbon composition for use in a fuel for compression ignition engines, said process consisting essentially of the steps of:

a. producing two or more synthesis gas products from a solid, liquid or gaseous carbonaceous feedstock by at least one synthesis gas production process, wherein the two or more synthesis gas products are blended;

b. subjecting the two or more synthesis gas products to a High Temperature Fischer-Tropsch synthesis to obtain a first synthetic hydrocarbon and water, wherein the first synthetic hydrocarbon has a sulphur content of below 5 ppm and a density of from 0.800 to 0.845 kg/l at 15° C.;

c. subjecting the two or more synthesis gas products to a Low Temperature Fischer-Tropsch synthesis to obtain a second synthetic hydrocarbon and water, wherein the second synthetic hydrocarbon has a sulphur content of below 5 ppm;

d. hydroconverting at least a fraction of the first synthetic hydrocarbon to produce one or more High Temperature Fischer-Tropsch process-derived hydrocarbons in the boiling range of from 150° C. to 390° C.;

e. hydroconverting at least a fraction of the second synthetic hydrocarbon to produce one or more Low Temperature Fischer-Tropsch process-derived hydrocarbons in the boiling range of from 150° C. to 390° C.; and f. blending the hydrocarbons produced in steps d. and e. to form a hydrocarbon composition for use in a fuel for compression ignition engines, wherein the hydrocarbon composition has a sulphur content of below 5 ppm, a paraffin content of at least 75 vol. %, and an aromatics content above 9 mass %.

2. A process as claimed in claim 1, wherein the High Temperature Fischer-Tropsch process-derived hydrocarbon comprises hydrotreated distillate diesel and the Low Temperature Fischer-Tropsch process-derived hydrocarbon comprises gas-to-liquid diesel, and wherein the hydrotreated distillate diesel and the gas-to-liquid diesel are blended at a ratio of from 1:100 to 100:1 on a volume basis.

3. A process as claimed in claim 2, wherein the hydrotreated distillate diesel and the gas-to-liquid diesel are blended at a ratio from 1:40 to 40:1 on a volume basis.

4. A process as claimed in claim 3, wherein the hydrotreated distillate diesel and the gas-to-liquid diesel are blended at a ratio from 1:20 to 20:1 on a volume basis.

5. A process as claimed in claim 1, wherein the first synthetic hydrocarbon and the second synthetic hydrocarbon are blended, prior to hydroconversion, in a ratio of 1:100 to 100:1 on a volume basis.

6. A process as claimed in claim 5, wherein the first synthetic hydrocarbon and the second synthetic hydrocarbon are blended, prior to hydroconversion, in a ratio of 1:40 to 40:1 on a volume basis.

7. A process as claimed in claim 1, wherein the Low Temperature Fischer-Tropsch process-derived hydrocarbons comprise less than 1 vol. % total aromatics.

8. A process as claimed in claim 7, wherein the one or more High Temperature Fischer-Tropsch process-derived hydrocarbons comprise about 25 vol. % monoaromatics.

9. A process for the production of a hydrocarbon composition for use in a fuel for compression ignition engines as claimed in claim 1, said process consisting of steps a. through f.

10. A process as claimed in claim 1, wherein the hydrocarbon composition has a paraffin content between 75 vol. % and 98 vol. %.

11. A process as claimed in claim 1, wherein the fuel is configured to produce less than 0.05 g/km of particulate matter when combusted in a passenger vehicle.

12. A process for the production of a hydrocarbon composition for use in a fuel for compression ignition engines, said process consisting essentially of the steps of:

a. producing two or more synthesis gas products from a solid, liquid or gaseous carbonaceous feedstock by at least one synthesis gas production process, wherein the two or more synthesis gas products are blended;

b. subjecting the blended two or more synthesis gas products to a High Temperature Fischer-Tropsch synthesis to produce a first synthetic hydrocarbon composition and water, wherein the first synthetic hydrocarbon has a sulphur content of 0.0003 mass % and a density of from 0.800 to 0.845 kg/l at 15° C.;

c. subjecting at least a fraction of the first synthetic hydrocarbon to hydrocracking, hydrotreatment and distillation to produce one or more High Temperature Fischer-Tropsch process-derived hydrocarbons in a boiling range of from 150° C. to 390° C.;

d. subjecting the blended two or more synthesis gas products to a Low Temperature Fischer-Tropsch synthesis to produce a second synthetic hydrocarbon and water, wherein the second synthetic hydrocarbon has a sulphur content of <0.0001 mass %;

e. subjecting at least a fraction of the second synthetic hydrocarbon to hydrocracking, hydrotreatment and distillation to produce one or more Low Temperature Fischer-Tropsch process-derived hydrocarbons in the boiling range of from 150° C. to 390° C.; and f. blending at least one of the one or more High Temperature Fischer-Tropsch process-derived hydrocarbons and at least one of the one or more Low Temperature Fischer-Tropsch process-derived hydrocarbons to form a hydrocarbon composition for use in a fuel for compression ignition engines, wherein the hydrocarbon composition has a sulphur content of below 5 ppm, a paraffin content of at least 75 vol. %, and an aromatics content above 9 mass %.

13. A process as claimed in claim 12, wherein the hydrocarbon composition has a density of at least 0.78 kg/l at 15° C., a Long Term Storage Stability below 1.35 mg/100 ml total insolubles formed, an initial boiling point as measured according to ASTM D86 method of above 150° C. and a T95 below 360° C., a final boiling point as measured according to ASTM D86 method of below 390° C., an oxidation stability below 0.7 mg/100 ml total insolubles formed, and a bromine number below 10 gBr/100 g.

14. A process for the production of a hydrocarbon composition for use in a fuel for compression ignition engines, said process consisting essentially of the steps of:

a. producing two or more synthesis gas products from a solid, liquid or gaseous carbonaceous feedstock by at least one synthesis gas production process, wherein the two or more synthesis gas products are blended;

b. subjecting the blended two or more synthesis gas products to a High Temperature Fischer-Tropsch synthesis to produce a first synthetic hydrocarbon and water, wherein the first synthetic hydrocarbon has a sulphur content of 0.0003 mass % and a density of from 0.800 to 0.845 kg/l at 15° C., c. subjecting the blended two or more synthesis gas products to a Low Temperature Fischer-Tropsch synthesis to produce a second synthetic hydrocarbon and water, wherein the second synthetic hydrocarbon composition has a sulphur content of <0.0001 mass %;

d. blending at least a fraction of the first synthetic hydrocarbon and at least a fraction of the second synthetic hydrocarbon to obtain a synthetic hydrocarbon blend; and e. subjecting at least a fraction of the synthetic hydrocarbon blend to hydrocracking, hydrotreatment and distillation to produce a hydrocarbon composition for use in a fuel for compression ignition engines, wherein the hydrocarbon composition has a sulphur content of below 5 ppm, a paraffin content of at least 75 vol. %, and an aromatics content above 9 mass %.

15. A process as claimed in claim 14, wherein the hydrocarbon composition has a density of at least 0.78 kg/l at 15° C., a Long Term Storage Stability below 1.35 mg/100 ml total insolubles formed, an initial boiling point as measured according to ASTM D86 method of above 150° C. and a T95 below 360° C., a final boiling point as measured according to ASTM D86 method of below 390° C., an oxidation stability below 0.7 mg/100 ml total insolubles formed, and a bromine number below 10 gBr/100 g.

* * * * *